US007607858B1

(12) United States Patent
Mosholder et al.

(10) Patent No.: US 7,607,858 B1
(45) Date of Patent: Oct. 27, 2009

(54) SECURE MANHOLE ACCESSWAY

(75) Inventors: Gary S. Mosholder, Sykesville, MD (US); Thomas Zuby, Linthicum, MD (US)

(73) Assignee: The United States of America as represented by the Director, The National Security Agency, Washington, DC (US)

( * ) Notice: Subject to any disclaimer, the term of this patent is extended or adjusted under 35 U.S.C. 154(b) by 49 days.

(21) Appl. No.: 12/154,813

(22) Filed: May 13, 2008

(51) Int. Cl.
*E06B 11/00* (2006.01)

(52) U.S. Cl. ..... 404/25; 52/19; 49/49

(58) Field of Classification Search ..... 404/25, 404/26; 52/19, 20
See application file for complete search history.

(56) References Cited

U.S. PATENT DOCUMENTS

| | | | | |
|---|---|---|---|---|
| 4,101,236 | A | 7/1978 | Meyer | |
| 4,461,597 | A * | 7/1984 | Laurin | 404/25 |
| 4,614,065 | A * | 9/1986 | Papp | 52/20 |
| 5,328,291 | A | 7/1994 | Wisniewski | |
| 5,727,351 | A * | 3/1998 | Neathery et al. | 52/20 |
| 5,827,007 | A | 10/1998 | Barton et al. | |
| 5,951,200 | A | 9/1999 | Barton | |
| 5,966,876 | A * | 10/1999 | Neathery et al. | 52/20 |
| 5,987,824 | A * | 11/1999 | Fuller | 52/19 |
| 6,161,985 | A * | 12/2000 | Hinkle et al. | 404/26 |
| 6,584,734 | B2 * | 7/2003 | Mihalicz et al. | 52/19 |
| 6,769,834 | B1 * | 8/2004 | Stange | 404/25 |
| 6,881,007 | B2 * | 4/2005 | Dennis | 404/25 |
| 7,178,290 | B2 | 2/2007 | Gowland | |
| 7,484,908 | B2 * | 2/2009 | Stadler | 404/25 |

* cited by examiner

*Primary Examiner*—Raymond W Addie
(74) *Attorney, Agent, or Firm*—Eric Froehlich

(57) ABSTRACT

An enhanced security manhole cover is disclosed, comprising a frame, outer cover, inner cover, crossbar, saddle, eyebolt, and padlock. The inner cover, which closes the lower opening in a manhole, includes a detent in the top surface for receiving the eyebolt. The crossbar is positioned above the inner cover and engages the walls of the frame. The crossbar includes a threaded hole that aligns with the detent. The saddle, an upside down U-shaped member, is positioned over the crossbar and includes a slot for the eyebolt to partially extend through. The saddle may include a shoulder on the base, to protect the eyebolt. The eyebolt passes partially through the saddle and crossbar and threads into the bore. The shackle of the padlock passes through holes in the upright of the U-shaped saddle below the crossbar, locking the saddle in place. The upper cover closes the top of the frame.

9 Claims, 2 Drawing Sheets

SECURE MANHOLE ACCESSWAY

FIELD OF THE INVENTION

The present invention relates, in general, to static structures and in particular, to an entrance for persons or objects with a horizontal cover and enclosure structure such as a manhole.

BACKGROUND OF THE INVENTION

Modern telecommunications equipment is increasingly utilizing underground vaults and conduits that are accessible by sealed manhole openings. Typically, the manhole opening consists of an annular frame attached to the telecommunications vault below grade. A circular disk provides a top cover to seal the annular frame from the elements and intrusion by people and animals.

Typical prior art manhole openings may also provide a gasket so rain water and contaminants do not enter the telecommunications vault. The gasket may be a loose gasket, a foamed in place gasket affixed to either the annular frame or the cover, or an O-ring.

Also known in the prior art is a system of two-cover manhole openings, such as a system sold by Neenah Foundry, specifically their R-1751 series telephone manhole frame with outer and inner lid. This type of manhole access system provides a level of water resistance and security to the telecommunications vault.

The Neenah Foundry product comprises an annular frame comprising a peripheral frame, with a top opening and a bottom opening. Also included are a top cover, a bottom cover, a crossbar, eyebolt, and a saddle. The top cover and bottom cover are circular disks with a top surface and a bottom surface. The bottom surface of the bottom cover engages a portion of the peripheral wall of the frame to seal the telecommunications vault below the manhole opening. In the middle of the top surface of the bottom cover is a threaded bore that extends a distance into the top surface of the bottom cover. Above the bottom cover, the crossbar is installed inside the annular frame and engages the peripheral wall. In the center of the crossbar is a threaded hole, which aligns with the concave feature in the bottom cover. The saddle is installed on top of the crossbar. The saddle is a U-shaped member and includes a slot through the base of the U. An eyebolt is threaded into the crossbar which applies pressure to the concave feature in the bottom cover. The U-shaped saddle is installed upside down, forming an n-shape, with the slot in the base aligned with the eyebolt in the crossbar, which locks the eyebolt in place. The shank of a padlock is passed through the eye of the eyebolt, which locks the saddle in place, preventing the eyebolt from turning. With the bottom cover now secured, the top cover can be installed over the top opening in the frame.

U.S. Pat. No. 4,101,236, entitled "SEALING MANHOLE COVER FOR USE ON EXISTING UNSEALED SANITARY SEWER MANHOLE COVER FRAME," discloses a cover for an unsealed manhole that incorporates an O-ring on one surface to engage the frame, thus providing a seal. U.S. Pat. No. 4,101,236 does not provide protection against tampering or unauthorized entry. The present invention is not limited in this regard. U.S. Pat. No. 4,101,236 is hereby incorporated by reference into the specification of the present invention.

U.S. Pat. No. 5,328,291, entitled "LOCKING MANHOLE INSERT," discloses a cover for a manhole frame that incorporates a plurality of radial arms that engage the peripheral wall of the annular manhole frame. The radial arms are secured with a padlock to prevent unauthorized entry and may be retracted for access. The present invention does not use radial arms as described in U.S. Pat. No. 5,328,291. U.S. Pat. No. 5,328,291 is hereby incorporated by reference into the specification of the present invention.

U.S. Pat. No. 5,827,007, entitled "ENTRANCE-DETERRING CAP FOR MANHOLE OPENINGS," and U.S. Pat. No. 5,951,200, entitled "ENCLOSEMENT TO SHIELD STRUCTURE WHICH SECURES ENTRANCE-DETERRING CAP TO MANHOLE OPENING FROM WATER AND DIRT CONTAINMENTS," discloses a cover for a manhole frame that seeks to prevent unauthorized access. The device disclosed provides an annular pan with a lip that engages the top of the manhole annular frame. Below the annular pan is an elongated bar that extends from one side of the peripheral wall to the opposite side. A threaded rod with a bore perpendicularly positioned relative to the length and series of nuts attaches the annular pan to the elongated bar, locking the two together. A padlock is used to lock the nuts to the threaded rod by passing the shackle through the bore in the threaded rod. The present invention does not use an annular pan or specialty threaded rod as described in U.S. Pat. No. 5,827,007 and U.S. Pat. No. 5,951,200. U.S. Pat. No. 5,827,007 and U.S. Pat. No. 5,951,200 are hereby incorporated by reference into the specification of the present invention.

U.S. Pat. No. 7,178,290, entitled "MANHOLE COVER HAVING A LOCKING CROSSBAR," discloses a rectangular pit cover having a small hinged opening for access to padlockable crossbar. The crossbar engages the peripheral walls of the pit cover frame, much like the peripheral wall of the manhole frames described above and is used to prevent unauthorized removal of the pit cover. The small hinged opening does not lock or require tools to open, providing an easy opportunity for tampering. The device described in U.S. Pat. No. 7,178,290 also requires modified manhole covers, increasing the cost of adoption. The present invention does not use a hinged opening within the outer cover for gaining access to a padlocked crossbar as described in U.S. Pat. No. 7,178,290. U.S. Pat. No. 7,178,290 is hereby incorporated by reference into the specification of the present invention. There exists a need to secure manhole covers with an enhanced security device that does not damage the padlock and is inexpensive to retrofit to existing manhole frames.

SUMMARY OF THE INVENTION

It is an object of the present invention to provide an enhanced security manhole cover.

It is a further object of the present invention to provide a manhole cover that is easily upgradeable for the type of manhole cover currently in use for telecommunications vaults.

The present invention is an improvement of the telecommunications vault manhole covers typically used, such as the ones, made by Neenah Foundry.

The present invention comprises a manhole cover frame, which typically is annular shaped, with the frame having a top opening, a bottom opening, and a peripheral wall. An outer cover engages the peripheral wall to cover the top opening, and an inner or bottom cover engages the peripheral wall to cover the bottom opening. The inner cover has a concave feature in the cover to receive an eyebolt (described below.)

Between the top cover and inner cover, a crossbar is used to block unauthorized removal of the inner cover. The crossbar engages the peripheral wall and includes a threaded hole that aligns with the concave feature of the inner cover.

An eyebolt is threaded through crossbar, engaging the concave feature in the inner cover. On top of the crossbar is placed an upside down U-shaped saddle. The base of the U has a slot that aligns with the eyebolt in the crossbar, as well as a hole in each of the upright sections to permit a shackle of a padlock to pass through. The padlock shackle is used to secure the saddle to the crossbar, thereby preventing removal of the eyebolt and opening the inner cover.

DETAILED DESCRIPTION OF THE INVENTION

The present invention is an enhanced security manhole cover. The present invention provides an easy and cost effective upgrade to existing manhole covers typically used to secure telecommunications vaults and provides greater physical security to the manhole cover.

The present invention provides security via an improved method of physical protection to the closure mechanism of certain manhole cover closure systems.

In the prior art devices, for instance the Neenah Foundry Company's manhole cover system described above, involves the use of a saddle, an eyebolt, a crossbar, and a padlock. When installed, the padlock shackle passes through the eye of the eyebolt, thereby preventing removal of the saddle, which in turn prevents turning of the eyebolt, which prevents loosening and removing the crossbar and ultimately removal of the lower cover.

The main disadvantage of this type of prior art device is that during manual removal of the top manhole cover, the outer edge of the cover may swing down and impact the locking mechanism, causing damage to the lock, saddle, or eyebolt.

Figure 1:
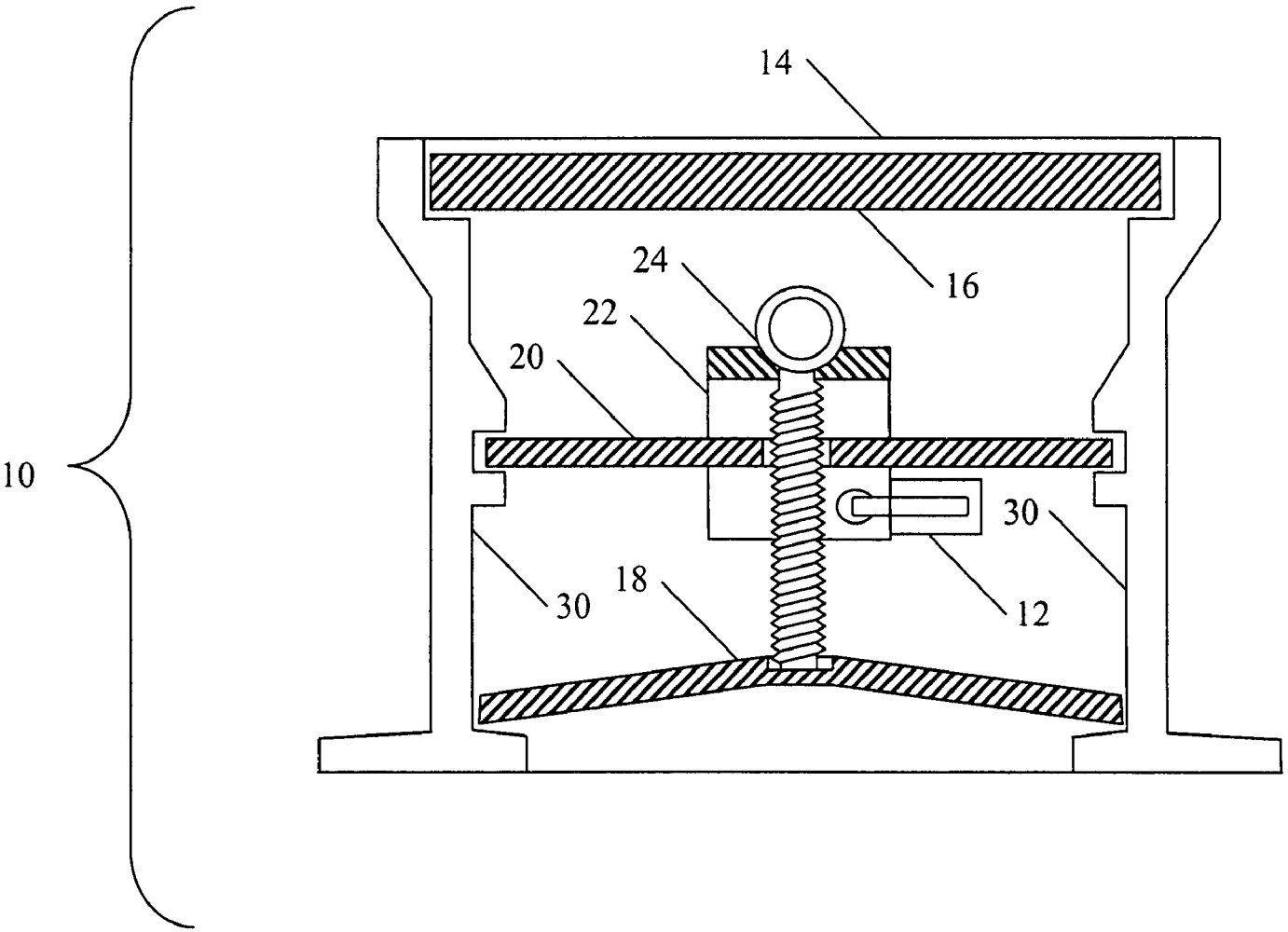
FIG. 1 is a cross-sectional view of the present invention.

Referring to FIG. 1, a secure manhole accessway 10 according to the present invention is shown. The secure manhole accessway 10 of the present invention includes a padlock 12, a manhole cover frame 14, an outer cover 16, an inner cover 18, a crossbar 20, a saddle 22, and an eyebolt 24.

The padlock 12 may be any standard padlock that has a shackle long enough to pass through the holes in the saddle 22 (described below.) Alternatively, the padlock 12 may include tamper indicating mechanisms to provide an additional indication of unauthorized entry.

The manhole cover frame 14 is typically annular in shape but may be any shape such as square or rectangular. The manhole cover frame 14 has a peripheral wall 30 and a top opening and a bottom opening.

In an alternate embodiment, a gasket (not shown) may be included between either the outer cover 16 and the manhole cover frame 14, or the inner cover 18 and the manhole cover frame 14. The gasket may be a 0-ring, a flat gasket, or a foamed in place gasket that is applied to the manhole cover frame 14, the inner cover 18, or the outer cover 16.

The outer cover 16 and inner cover 18 are also typical of the prior art manhole covers in that they are typically disk like covers having a top surface and a bottom surface. Depending on whether the cover is the outer cover 16 or inner cover 18, either the top surface or bottom surface engages a portion of the peripheral wall 30 of the manhole cover frame 14. The outer cover 16 is configured to removably cover the top opening in the manhole cover frame 16, while the inner cover 18 is configured to removably cover the bottom opening in the manhole cover frame 16. As described in the prior art device above, the inner cover 18 also includes a detent, or concave feature in the top surface. The concave feature is designed to allow the eyebolt 24 to be pressed onto the inner cover 18, extending perpendicularly from the top surface of the inner cover 18.

The crossbar 20 is also similar to prior art crossbars. The crossbar has a first end and a second end that is separated a user-defined distance. The length of the crossbar 20 is selected to match the diameter of the manhole cover frame 14. The first end and the second end of the crossbar 20 removably engage the peripheral wall of the manhole cover frame 14. Between the first end and the second end is a threaded hole in the crossbar 20 that is designed to align with the concave feature or detent in the top surface of the inner cover 18.

The saddle 22 is a U-shaped member that is designed to fit, upside down, over the crossbar 20. The U-shape saddle 22 has a base and two upright sections. The base has an oblong slot in it of a slightly larger size as the head of the eyebolt 24 and at least one hole in each of the two upright sections. The pair of holes in the upright sections is designed to align, so that the shackle of the padlock 12 can pass through. Furthermore, the saddle 22 is sized to allow the base to fit over the top of the crossbar 20 and the upright sections of the saddle 22 to extend below the crossbar 20, allowing the shackle of the padlock 12 to pass under the crossbar 20. With a saddle 22 design as described, the padlock 12 is protected from damage caused during removal of the outer cover 16.

Figure 2:
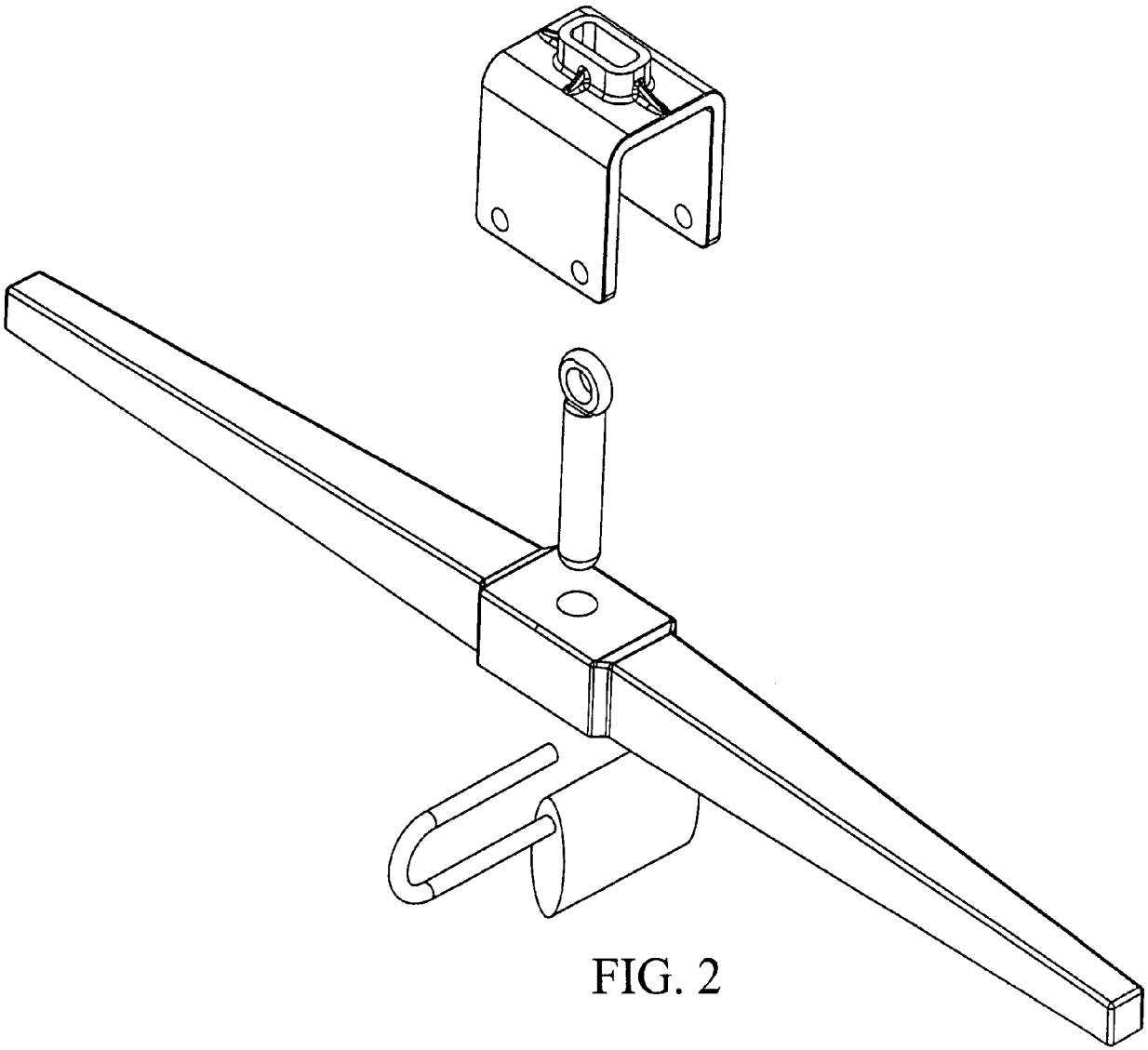
FIG. 2 is an exploded view of the crossbar-saddle-eyebolt-lock portion of the present invention.

Referring to FIG. 2, in another optional embodiment, the saddle 22 further comprises a shoulder portion on the opposite side of the base as the upright sections, somewhat forming a y-shape. The shoulder section provides additional protection to the eye of the eyebolt 24 against damage and tampering. Optionally, ribs on the shoulder are a means of built in tamper indication as well.

Referring again to FIG. 1, the eyebolt 24 is a standard eyebolt known to persons skilled in the art, selected so that the eyebolt 24 is long enough to extend through the slot in the base of the saddle 22, through the threaded hole in the crossbar 20, and press into the concave feature in the top surface of the inner cover 18. In the present invention, the eye of the eyebolt 24 is at least partially covered by the oblong slot in the base of the saddle 22. In the optional embodiment described above wherein the saddle 22 includes a shoulder, all or substantially all of the eye of the eyebolt 24 is covered.

In the prior art device, the padlock shackle passed through the eye in the eyebolt, preventing the removal of the saddle, thereby preventing removal of the eyebolt. This prevented removal of the crossbar and ultimately the inner cover.

The relocation of the holes in the saddle 22 below the crossbar 20 provides protection of the padlock from damage. The operation of the saddle 22 in the present invention is similar to the operation of the prior art saddle, except that the padlock 12 is now mounted below the crossbar 20. This change provides additional protection to the padlock 12 from inadvertent damage during removal of the outer cover 14.

Access to, and removal of the eyebolt 24 is restricted with both designs, however the saddle 22 of the present invention with the shoulder provides enhanced protection as a greater percentage of the eye of the eyebolt 24 is covered. This change makes it more difficult to remove the eye in a way that is unauthorized and also protects the eyebolt 24 from damage during removal of the outer cover 14.

The present invention also permits application and protection of tamper indicating products.

The novel and unique features with the present invention provides additional benefit for the support and protection of the padlock and tamper indicating device from damage. The collar on the base of the saddle 22 provide security to the eyebolt with the ribs providing inherent means of tamper protection.

While the preferred embodiments of the invention have been illustrated and described, it will be apparent to those of ordinary skill in the art that various changes and modifications may be made without deviating from the inventive concepts set forth above.

What is claimed is:

1. A secure manhole accessway, comprising:

a) a padlock, the padlock comprising a shackle, a lock, and a body;

b) a manhole cover frame, the manhole cover frame having a peripheral wall, a top opening, and a bottom opening;

c) an outer cover, the outer cover removably abutting the peripheral wall of the manhole cover frame and configured to cover the top opening;

d) an inner cover, the inner cover having a top surface, the inner cover removably abutting the peripheral wall along the bottom opening in the manhole cover frame and configured to cover the bottom opening, the inner cover further comprising a detent in the top surface;

e) a crossbar, the crossbar having a first end and a second end separated a distance from the first end, the first end and second end removably engaging the peripheral wall of the manhole cover frame, and the crossbar further comprising a threaded bore extending through the crossbar and aligned with the detent in the top surface of the inner cover;

f) a saddle, the saddle having U-shape comprising a base and two upright sections, the saddle further comprising an oblong via extending through the base of the U and at least one via extending through each of the upright sections of the U-shaped saddle, the vias in the upright sections aligned, allowing the shackle of the padlock to pass therethrough and allowing the shackle to pass under the crossbar, and the base of the saddle removably positionable over the crossbar with the oblong via in the base aligned with the threaded bore in the crossbar; and g) an eyebolt, the eyebolt extending through the oblong via in the base of the saddle, and removably engaging the threaded bore in the crossbar, and further engaging the detent of the top surface of the inner cover.

2. The secure manhole accessway of claim 1, wherein the saddle further comprises a shoulder section around the via in the base of the saddle, and extending a distance from the base of the saddle in a direction opposite the two upright sections forming a Y-shaped member.

3. The secure manhole accessway of claim 2, further comprising at least one rib extending from the base of the saddle to the shoulder section around the via in the base of the saddle.

4. The secure manhole accessway of claim 3, wherein the manhole cover frame has an annular shape.

5. The secure manhole accessway of claim 4, further comprising a gasket between at least one of the outer cover and the manhole cover frame, and the inner cover and the manhole cover frame.

6. The secure manhole accessway of claim 4, wherein the padlock further comprises a tamper indicating device.

7. The secure manhole accessway of claim 1, wherein the manhole cover frame has an annular shape.

8. The secure manhole accessway of claim 1, further comprising a gasket between at least one of the outer cover and the manhole cover frame, and the inner cover and the manhole cover frame.

9. The secure manhole accessway of claim 1, wherein the padlock further comprises a tamper indicating device.

* * * * *